United States Patent [19]

Walter

[11] 4,373,983

[45] Feb. 15, 1983

[54] MEANS FOR ASSEMBLING CONTAINER HALVES

[75] Inventor: John Walter, Evergreen Park, Ill.

[73] Assignee: Continental Group, Inc., Conn.

[21] Appl. No.: 246,454

[22] Filed: Mar. 23, 1981

Related U.S. Application Data

[63] Continuation-in-part of Ser. No. 40,354, May 18, 1979, abandoned.

[51] Int. Cl.[3] ..... B29D 3/00

[52] U.S. Cl. ..... 156/423; 29/458; 29/525; 29/446; 29/235; 29/801; 156/294

[58] Field of Search ..... 29/458, 450, 525, 446, 29/282, 796, 797, 235, 237, 801, 451; 156/294, 423; 220/3, 76; 493/108

[56] References Cited

U.S. PATENT DOCUMENTS

| | | | |
|---|---|---|---|
| 1,218,907 | 3/1917 | Shevlin | 493/108 |
| 1,929,275 | 10/1933 | Eudaly et al. | 29/450 UX |
| 2,676,391 | 4/1954 | Elder | 29/450 |
| 3,018,914 | 1/1962 | Webster | 220/3 |
| 3,346,435 | 10/1967 | Beck | 156/423 |
| 3,462,825 | 8/1969 | Pope et al. | 29/451 |
| 3,709,757 | 1/1973 | Sturley | 156/423 |
| 4,041,599 | 8/1977 | Smith | 29/458 X |
| 4,124,928 | 11/1978 | Stark | 29/451 X |
| 4,127,431 | 11/1978 | Susnjara | 156/293 X |

*Primary Examiner*—Charlie T. Moon

*Attorney, Agent, or Firm*—John J. Kowalik; Charles E. Brown

[57] ABSTRACT

Apparatus and method for assembling a pair of thin-walled metal container counterparts which are brought together axially, are rounded and one inserted into the other substantially without deformation of either of the pair of counterparts so that the inner part is allowed to expand, after insertion, radially and both parts at their juncture are stressed in hoop tension for tightly embracing an adhesive interposed therebetween and thereby insure a good bond at the seam.

10 Claims, 5 Drawing Figures

FIG. 2
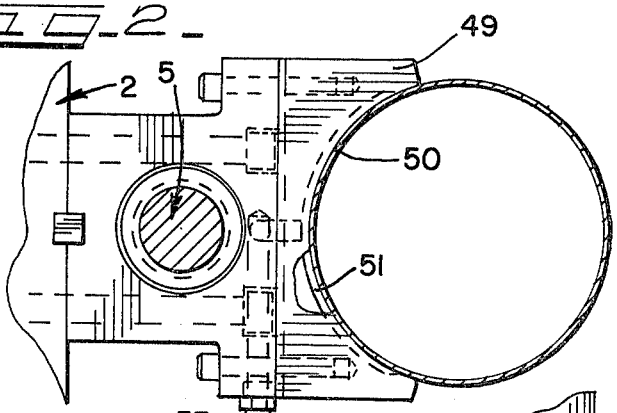
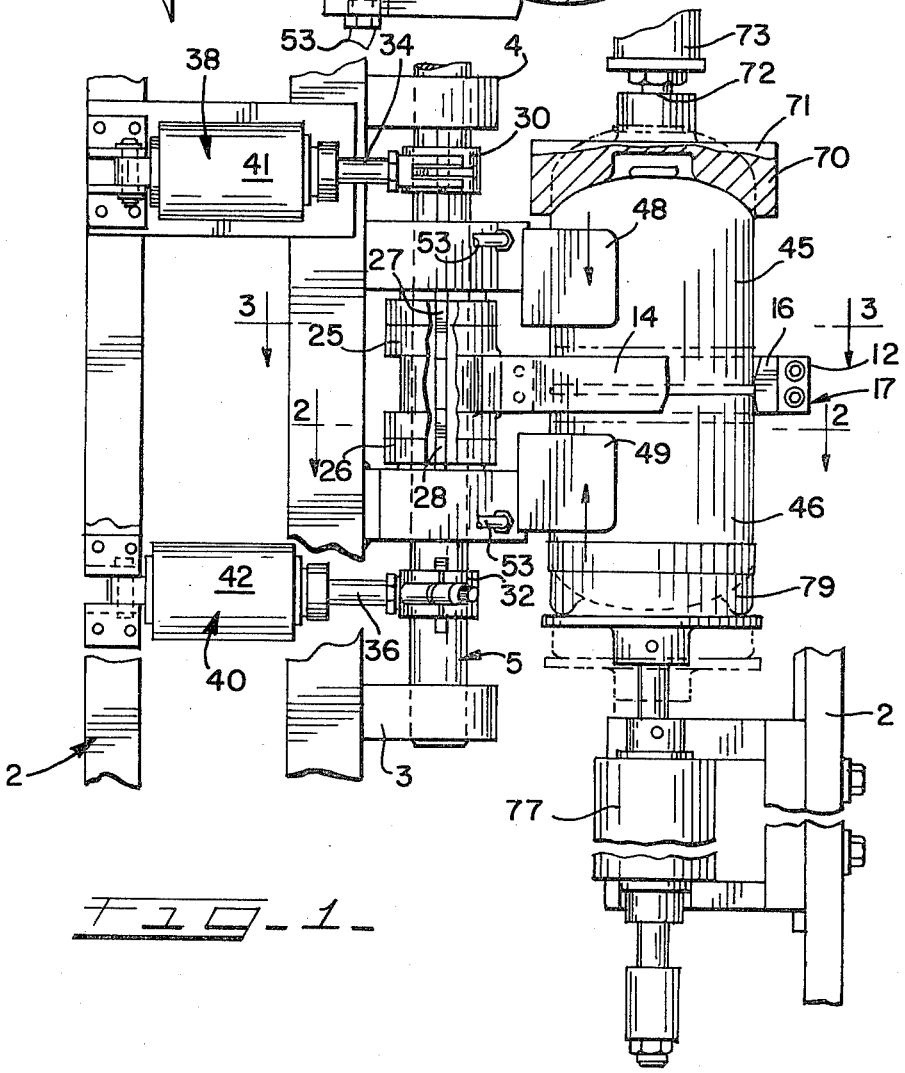
FIG. 1

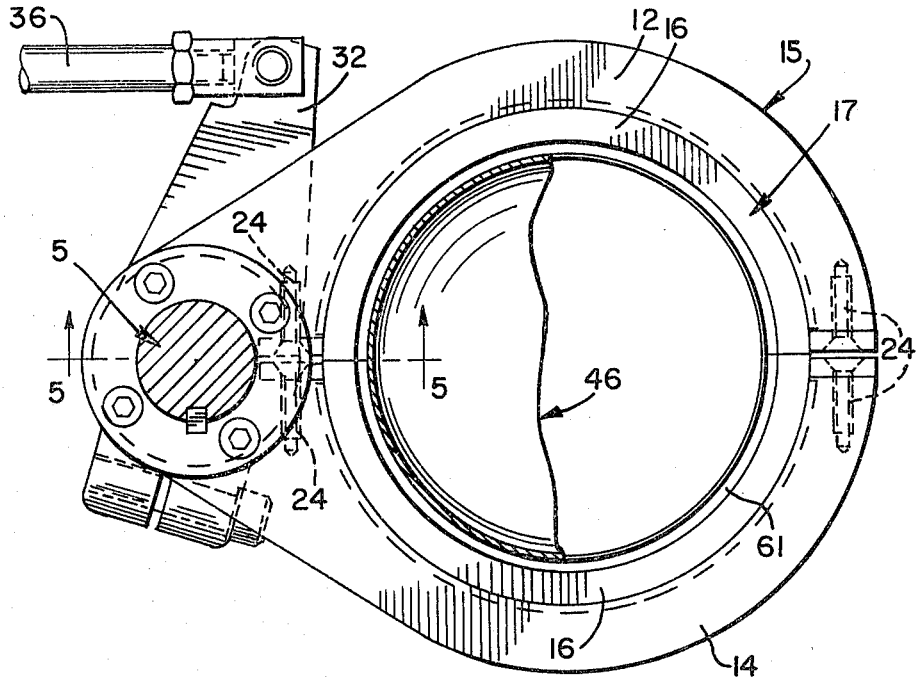
FIG. 3
FIG. 5
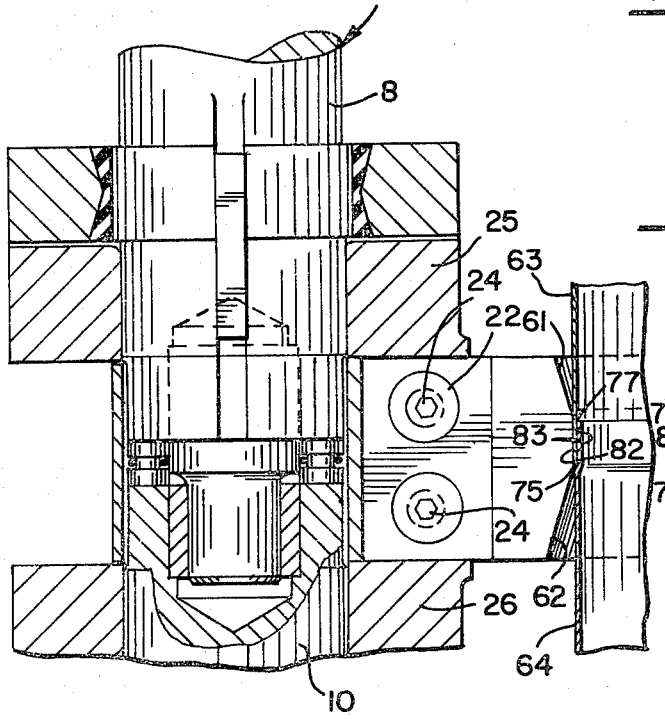
FIG. 4
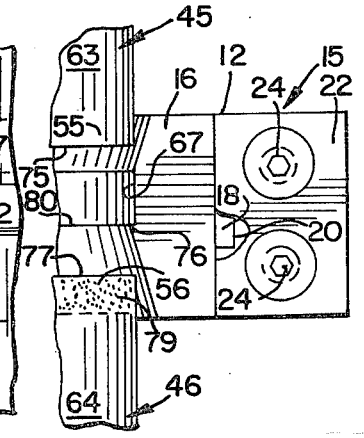

MEANS FOR ASSEMBLING CONTAINER HALVES

This application is a continuation-in-part of my application Ser. No. 40,354, filed May 18, 1979, now abandoned.

DISCUSSION OF THE INVENTION

The invention is directed to the making and assembling of thin-walled container halves, the walls having a thickness of between 0.006 and 0.0012 inches. Attempts at assembling such parts by conventional methods have failed in that even if one of the halves is necked in prior attempts at assembling, the flimsy nature of the side walls prevents their retaining a cylindrical shape and thus great difficulty has been experienced in rounding the parts and then axially pushing them together.

DISCUSSION OF THE PRIOR ART

The best prior art known to applicant is French Pat. No. 1,224,793 which comprises thick-walled cylinder halves, one of which is necked out and the second necked in, the second half being telescoped into the first and the halves are then welded together. This may be effective for thick-walled containers which retain their shape after reforming, but thin-walled containers, particularly if made from relatively soft metal such as aluminum, are very unstable in retaining their shape and thus are difficult to assemble and, in forming edges, are hard to control. This is especially significant for high-speed production of 400–1000 units per minute.

SUMMARY OF THE INVENTION

This invention concerns a novel method and apparatus for assembling such thin-walled container halves.

A particular object of the invention is to provide a novel apparatus employing a die member with a central opening in which one end provides a cylindrical portion having a diameter equal to the diameter of one of the halves and terminates in a stop shoulder at the bottom thereof, said cylindrical portion merging at the upper edge thereof with the narrow end of a frustoconical pilot surface which guides the edge portion of the container half into the cylindrical portion. The opposite end of the die is formed with a frustoconical necking-in surface which at its inner end is the radially inner edge of the shoulder against which the first end portion of the container rests. The shoulder has a radial width slightly greater than the thickness of the container wall seated thereon.

The first and second halves are advanced toward each other at opposite sides of the die and the second half is forced through the necking surface and is slightly necked in while the first half is disposed in receiving position. Thus, as the second half is being necked in, it also wedges into the first half. These operations are concurrent. Before the halves are fitted one into the other, the second or entrying half has a coating of adhesive applied thereto along its entering edge, although it will be understood the adhesive may be applied within the outer (first) container half at its juncture edge portion.

An important aspect of the invention resides in holding the outer container round (squared) in the same fixture that the entering portion of the inner container is slightly necked in and relatively advancing the two halves toward each other while holding them under control so that the inner container portion easily enters the open end of the outer portion. The inner portion is under compression and after release from the die, springs outwardly and produces a hoop tension in the outer portion.

These and other objects and advantages inherent in and encompassed by the invention will become more apparent from the specification and drawings, wherein:

FIG. 1 is a side elevational view partly in axial section of apparatus incorporating the invention;

FIG. 2 is a cross-sectional view taken substantially on line 2—2 of FIG. 1;

FIG. 3 is an enlarged cross-sectional view taken substantially on line 3—3 of FIG. 1;

FIG. 4 is an enlarged fragmentary view of a portion of the die member in cross-section showing the can parts in position preparatory to entering the die; and FIG. 5 is a fragmentary axial vertical section taken substantially on line 5—5 of FIG. 3 showing the can parts in assembled position.

DESCRIPTION OF THE INVENTION

Describing the invention in detail as shown in the drawings, the apparatus 1 comprises a support frame 2 which has a plurality of vertically aligned bearings 3 and 4 mounted thereon in which an operating shaft assembly 5 is journaled.

THe shaft assembly is split into two counter-rotary sections 8 and 10, which define an axis of support.

Shaft section 8 is connected to one jaw or clamp holder 12 and the shaft section 10 is connected to jaw or clamp holder 14 of die 15. The jaw sections each carry a half section segment 16 of a die ring 17. Each section 16 has a tongue 18 fitted into a groove 20 in the associated jaw or clamp holder 12 or 14. In addition, there is provided an end stop 22 at each end of segment 16 abutting the end of the same, the stop being attached by screws 24,24 threaded into the associated end portion of the jaw section 12 or 14. Jaws 12,14 have arms 25,26 respectively at one of their ends keyed by keys 27,28 to the respective shaft sections 8 and 10 in a central position.

The shaft sections 8 and 10 are connected to pistons 34,36 of air or hydraulic motors 38,40, the pistons operating in cylinders 42,44.

Thus, the clamps and their associated die sections are opened and closed by reversely turning the respective shaft sections in order to admit cup-shaped container halves or cups 45,46 which are made of metal, preferably aluminum of about 6–10 mils in thickness.

Associated delivery and discharge mechanism is used to bring the cups to the assembly apparatus 1 and to remove the assembled container but are of no concern as to the present invention.

As best seen in FIGS. 1 and 2, the assembly apparatus is provided with vacuum holders or chucks 48,49 which are mounted on the frame and each have an arcuately shaped pocket 40 with a vacuum slot 51 connected with an associated vacuum line 53.

The holders 48,49 releasably hold the upper and lower halves 45,46 of the container with the open end portions 55,56 (FIG. 4) thereof facing each other which normally tend to assume an out of round shape. The clamps are then closed about these open end portions as seen in the right half of FIG. 4. If desired, the clamps may first be closed and the halves advanced toward each other and entered into the upper and lower ends of the die 17. It will be noted that the upper and lower end portions of the dies are provided with truncated conical guide surfaces 61,62 which flare downwardly and upwardly respectively and at their outer ends provide lead-in-portions of substantial depth and which are of a diameter greater than that of the body portions 63,64 of the upper and lower cup sections. Thus, the edge portions 55,56 of the body portions 63,64 are easily guided into the center portion of the die.

The center portion of the die has an upper cylindrical die portion with a surface 67 which is equal to substantially the outside diameter of the upper cup. The upper cup is advanced into the surface 67 which rounds the lower edge portion of the upper cup by an upper pusher 70 which has a cap 71 at the lower end of rod 72 of a piston which operates in an air cylinder 73 carried by the frame.

The upper cup slips along the holder 48 and is guided into the cylindrical die surface 67 until the lower edge 75 of the upper cup seats upon the shoulder 76 at the bottom of the squaring surface 67. Simultaneously, with the upper cup being inserted into the cylindrical section 67, the lower cup is pushed upwardly by an air or hydraulic cylinder 77 which has a base pod bearing against the bottom or base 79 of the lower male cup. The edge portion 56 of the lower cup has been previously coated with an appropriate adhesive 79. The edge portion 56 of the lower cup is very slightly necked-in but not deformed as it moves past the shoulder 76. The inner edge of the shoulder 76 is of a diameter slightly less than the inner diameter of the upper cup, and the shoulder 76 has a radial dimension slightly larger than the thickness of themetal of the body wall of the upper cup.

It has been found that the fit of the lower cup edge portion into the upper edge portion merely springs the metal of the lower cup very slightly without permanent deformation and that upon release from the die, the hoop compressive forces on the edge portion 56 are slightly relieved and tensile hoop stressed develop in the edge portion 55. Thus, a tight fit is insured between the two halves and the adhesive which is preferably thermoplastic polyolefin resins such as carboxylated polypropylene or polyethylene as well as thermosetting resins such as epoxy resins. These resins, when heated, will distribute and bond in shear the opposing outer surface 82 of the inner portion 56 to the inner surface 83 of the outer portion 55. It will be noted that no inner support is required to telescope the two cups into each other and no wrinkling occurs at the juncture so that a good, leak-proof bond is developed which resists separation of the two halves in shear. It will be understood that any cold adhesive or thermoplastic adhesives may be used to bond the two halves.

After the two cup halves are assembled, the die is opened and the upper and lower pushers separated and a vacuum withdrawn from the holders and the assembled unit is withdrawn or drops out and the following two halves are entered into the apparatus at opposite sides of the die and assembled in a continuous process.

It will be apparent that the die assembly comprises a common axis and that the holders each include arcuately shaped pockets and are positioned in axial alignment with each other and centered relative to the die assembly axis. The upper cup body after being located in the cylindrical part 67 of the upper die is positioned to receive the end of the lower cup which reduces the diameter of the extreme end part 56 to a diameter less than twice the wall preselected thickness of the containers which are preferably of identical dimension. It will be noted that the adhesive 79 on the edge portion 77 provides anti-friction means in the nature of a lubricant so that it slides easily through shoulder 76. The adhesive also prevents any burrs which may remain on this edge after trimming, from breaking off and wedging between the overlapped portions leaving a leak gap therebetween, such burrs being securely embedded in the adhesive at the edge 77. The adhesive extends over the edge 77 and completely covers it and may even extend into the interior of the inner cup. The vacuum chucks 48,49 have their inner arcuate faces concentric with the axis of the die assembly and match the external diameters of the cups so that the cups are vertically axially aligned prior to assembly and thus merely have to be pushed toward each other for assembly. The pockets of the holders are axially aligned with each other and are centered relative to the die assembly axis.

Having described a preferred embodiment of the invention, it will be appreciated that various other variations will now become apparent to those skilled in the art which are comprehended within the scope of the appended claims:

I claim:

1. An apparatus for assembling a pair of thin-walled container cup bodies in open end to open end telescoped relation wherein each container cup body has a cylindrical free end body portion and said cylindrical body portions are substantially of the same preselected external diameter and wall thickness, said apparatus comprising a support, a die assembly mounted on said support in a central position, said die assembly having an axis, a pair of holders mounted on said support at opposite ends of said die assembly, said holders each including an arcuately shaped pocket, said pockets being in axial alignment with each other and centered relative to said die assembly axis, said die assembly defining a through opening and having a stepped cylindrical central portion including a cylindrical surface of an internal diameter corresponding to said preselected external diameter, a transverse annular shoulder at one end of said cylindrical surface, a first means at an opposite end of said cylindrical surface for engagement by a first container cup body end and for reshaping such first container cup body end to a cylindrical configuration of said preselected external diameter and for guiding such reshaped first container cup body end into that portion of said through opening defined by said cylindrical surface for engagement with said transverse annular shoulder, said first means being a frustoconical guide surface, second means at an end of said through opening remote from said first cylindrical surface for engagement by a second container cup body end and for both reshaping such second container cup body end and reducing the external diameter of an extreme end part of such second container cup body end to a diameter less than said preselected diameter less twice said preselected wall thickness and for guiding such reshaped and reduced diameter extreme end part of a second container cup body end portion into a reshaped first container cup body portion in telescoped relation to form a container, said second means also being a frustoconical guide surface and means for engaging the remote ends of said cup bodies and urging them toward each other.

2. The invention according to claim 1 and means associated with said holders for releasably holding the respective cup bodies and permitting said bodies to be moved axially.

3. The invention according to claim 1 and means associated with said holders for releasably holding the respective cup bodies and permitting said bodies to be moved axially while in alignment with each other.

4. The invention according to claim 1 and means for opening and closing said die assembly to release a formed container.

5. The invention according to claim 1 and said second container cup having adhesive means on said body end and said second means arranged to engage the adhesive for sliding contact therewith.

6. An apparatus for assembling a pair of thin-walled cup-shaped container sections adapted to be assembled end to end and each section comprising a cylindrical body wall which normally tends to assume an out of round shape;

a support;

means for mounting said sections from the support in axially spaced aligned relation and the end portion of each opposing the other;

a die assembly mounted on the support in a position to receive one of the container sections at one side thereof and the other container section at the opposite side thereof;

said die assembly comprising an opening therethrough;

outer guide means having lead-in portions of substantially greater diameter than that of the container sections and being of substantial depth at opposite sides of the die assembly for guiding and rounding the end portions of respective container sections;

said opening being defined at one side of the die assembly by a cylindrical surface disposed inwardly of the associated guide means as a continuation thereof and of a diameter to conformingly engage the external side of a container section insertable therein to shape and hold the same round;

said cylindrical surface terminating in an inwardly extending shoulder;

said guide means on the other side of said guide assembly extending through said shoulder and defining an inner edge thereof circumscribing said opening;

said shoulder having a radial extent slightly greater than the thickness of the body wall of the container section inserted into said cylindrical surface area;

and means for advancing said container sections toward one another and telescoping the end portion of one container into the end portion of the other, while sliding said sections on said mounting means, and said mounting means being disposed in concentric alignment with the axis of said die assembly.

7. The invention according to claim 6 and said mounting means including vacuum holding means slidably supporting the respective section.

8. The invention according to claim 7 and said mounting means comprising arcuate members shaped to grasp one side of a container cup section and hold the same in axial alignment with the die assembly.

9. The invention according to claim 8 and means for engaging the remote ends of said container cup sections and advancing them toward each other with said die assembly positioned therebetween.

10. A system for joining two container sections of equal external diameters, wherein one section is insertable into the other and each section being made of metal such as aluminum alloy and each section having a body side wall of less than 9 mils in thickness, an end wall connected to one end of the side wall and the body having a flexible open end portion at the other end terminating in a raw edge highly susceptible to distortion and crimping, means for applying a stabilizing flexible coating of adhesive on the open end portion of at least one of said sections, means for axially aligning said sections with their open ends portions toward each other, means for shaping one of said sections into a cylindrical shape at said open end portion, means for imposing a hoop stress on the open end portion of the other section to an extent sufficient to reduce the diameter of the other section less than the internal diameter of said one section means for urging said sections towards each other and effecting insertion of said end portion of the other section into said one section end portion while thus maintaining said other section reduced in diameter, means for releasing said shaping and hoop stress imposing means and thereby permitting said end portion of said other section to expand within said end portion of said one section, and means for heating said adhesive to effect a bond between said portions.

* * * * *